United States Patent [19]

Kitazawa et al.

[11] Patent Number: 4,885,825

[45] Date of Patent: Dec. 12, 1989

[54] BUCKLE APPARATUS

[75] Inventors: Yasuho Kitazawa; Kazuyoshi Ishiguro, both of Aichi, Japan

[73] Assignee: Kabushiki Kaisha Tikai-Rika-Denki-Seisakusho, Ohaza-Toyota, Japan

[21] Appl. No.: 208,133

[22] Filed: Jun. 17, 1988

[30] Foreign Application Priority Data

Jun. 18, 1987 [JP] Japan ..... 62-093838[U]

[51] Int. Cl.[4] ..... A44B 11/26

[52] U.S. Cl. ..... 24/639; 24/642; 24/644

[58] Field of Search ..... 24/633, 639, 640, 642, 24/644, 574, 194; 297/468

[56] References Cited

U.S. PATENT DOCUMENTS

| | | | |
|---|---|---|---|
| 3,523,340 | 8/1970 | Stoffel | 24/639 |
| 3,704,492 | 12/1972 | Meredith, Sr. | 24/639 |
| 4,062,091 | 12/1977 | Holmberg | 24/644 |
| 4,262,396 | 4/1981 | Koike | 24/642 |
| 4,704,771 | 11/1987 | Orje | 24/574 |

FOREIGN PATENT DOCUMENTS

| | | | |
|---|---|---|---|
| 0751599 | 1/1967 | Canada | 24/644 |
| 56-58316 | 5/1981 | Japan . | |
| 62-42409 | 3/1987 | Japan . | |
| 62-78109 | 5/1987 | Japan . | |
| 1156406 | 6/1969 | United Kingdom | 24/642 |
| 2083542 | 3/1982 | United Kingdom | 24/642 |

*Primary Examiner*—Victor N. Sakran

*Attorney, Agent, or Firm*—Sixbey, Friedman, Leedom & Ferguson

[57] ABSTRACT

A buckle apparatus for use in a plurality of seatbelt assemblies each having a tongue plate and a buckle and disposed adjacent to each other is arranged such that widths of an opening of a tongue plate-inserting passage of each buckle as well as a portion thereof adjacent to the opening differ to allow only a predetermined tongue plate and buckle to be engaged with each other.

7 Claims, 8 Drawing Sheets

BUCKLE APPARATUS

BACKGROUND OF THE INVENTION

1. Field of the Invention

The present invention relates to a buckle apparatus for use in a plurality of seatbelt assemblies disposed adjacent to each other in a vehicle or the like.

2. Description of the Related Art

A seatbelt system disposed in a vehicle such as an automobile is adapted so that an occupant, after having been seated, applies a webbing for restraining himself by causing a buckle to be engaged with a tongue plate fixed to the webbing.

However, with a conventional buckle, there has been a drawback in that it is possible for a buckle of one seatbelt assembly to be engaged with a tongue plate of another disposed nearby in the same vehicle.

SUMMARY OF THE INVENTION

Accordingly, an object of the present invention is to provide a buckle apparatus for use in a plurality of seatbelt assemblies each having a tongue plate and a buckle and disposed adjacent to each other, wherein a buckle of one seatbelt system cannot be engaged with a tongue plate of another, thereby overcoming the drawback of the prior art.

To this end, according to the present invention, there is provided a buckle apparatus for use in a plurality of seatbelt assemblies each having a tongue plate and a buckle and disposed adjacent to each other, the buckle being provided with a lock member and being engageable with the tongue plate as the tongue plate is inserted into the buckle, the buckle apparatus comprising: a first buckle having a first portion for forming an opening of a tongue plate-inserting passage and having a large width and a second portion having a width which becomes gradually smaller in the vicinity of the entrance in the direction of a forward end of the buckle, as viewed in the direction of insertion of the tongue plate; a second buckle having a third portion having a width which becomes smaller from an opening of the tongue plate-inserting passage to a predetermined position in the direction of insertion of the tongue plate and a fourth portion which is formed continuously from the third portion in the direction of insertion of the tongue plate and whose width is made abruptly smaller than that of the third portion; a first tongue plate which can be inserted into the first buckle up to a position for engagement with the lock member, but which cannot be inserted into the second buckle up to the position for engagement with the lock member, the width of a portion thereof corresponding to the first portion of the first buckle being made larger than that of the third portion of the second buckle; and a second tongue plate which can be inserted into the second buckle up to a position for engagement with the lock member, but which cannot be inserted into the first buckle up to the position for engagement with the lock member, the width of a portion thereof corresponding to the third portion of the second buckle being made abruptly larger than that of the second portion of the first buckle.

According to the buckle apparatus having the above-described arrangement, even if an attempt is made to engage the second tongue plate with the first buckle, the second tongue plate cannot be inserted up to a position for engagement with the lock member since a change in the width of the tongue plate-inserting passage in the vicinity of the opening of the tongue plate-inserting passage of the first buckle is too gradual.

In addition, when an attempt is made to engage the first tongue plate with the second buckle, the first tongue plate cannot be inserted up to a position for engagement with the lock member since the width of the opening of the tongue plate-inserting passage of the second buckle is too narrow, so that the first tongue plate cannot be engaged with the second buckle.

BRIEF DESCRIPTION OF THE DRAWINGS

The accompanying drawings illustrate the preferred embodiment of a buckle apparatus of the present invention, in which.

DESCRIPTION OF THE PREFERRED EMBODIMENTS

Figure 1:
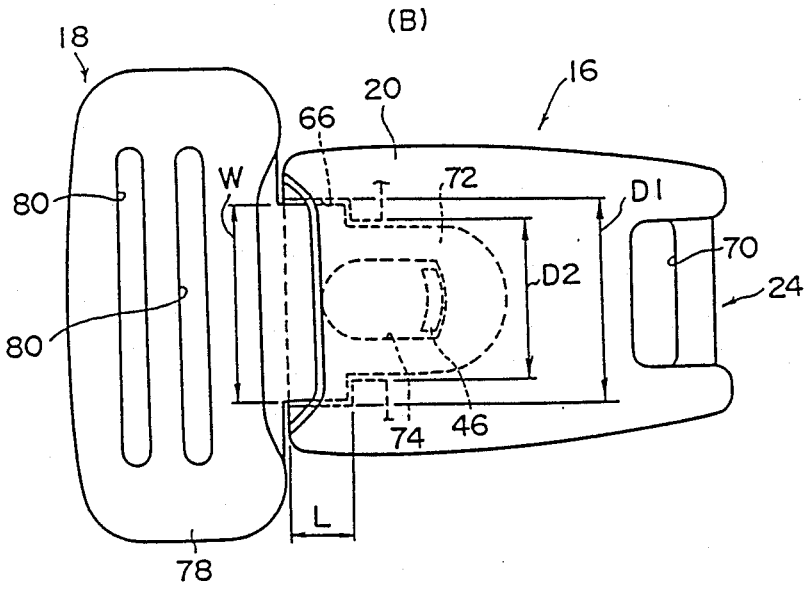
FIG. 1A is a top plan view illustrating a state in which a first buckle and a first tongue plate are engaged with each other.
FIG. 1B is a top plan view illustrating a state in which a second buckle and a second tongue plate are engaged with each other.
Figure 2:
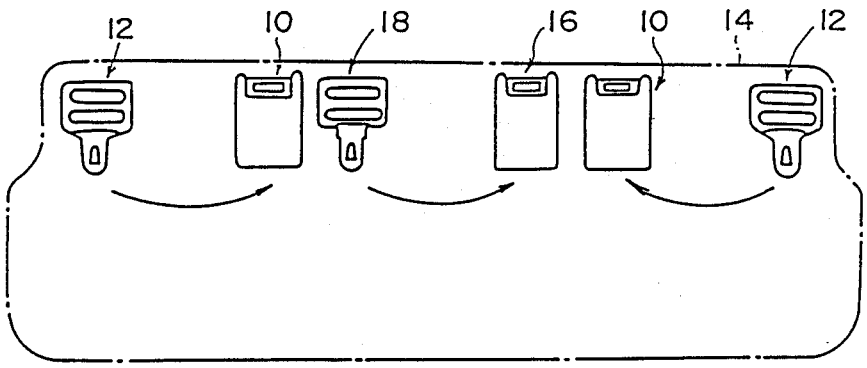
FIG. 2 is a conceptual diagram illustrating a layout of the first and second buckles and the first and second tongue plates arranged on a seat.

FIGS. 1A and 1B illustrate an embodiment of a buckle apparatus in accordance with the present invention. A first buckle 10 and a first tongue plate 12 both shown in FIG. 1A are adapted to be applied to a rear seat 14 of a vehicle designed for three persons to be seated thereon, as shown in FIG. 2. In addition, a second buckle 16 and a second tongue plate 18 which is engaged therewith are adapted to be applied to a seatbelt assembly for a central occupant, as shown in FIG. 2.

First, a description of the first buckle 10 and the first tongue plate 12 will be given with reference to FIGS. 1A, 3, 4, and 5.

Figure 3:
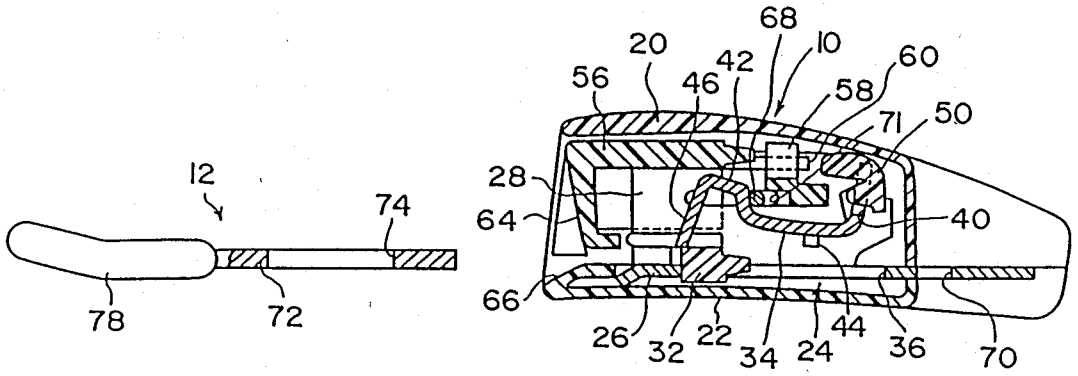
FIG. 3 is a cross-sectional view illustrating a state in which the first tongue is withdrawn from the first buckle.
Figure 5:
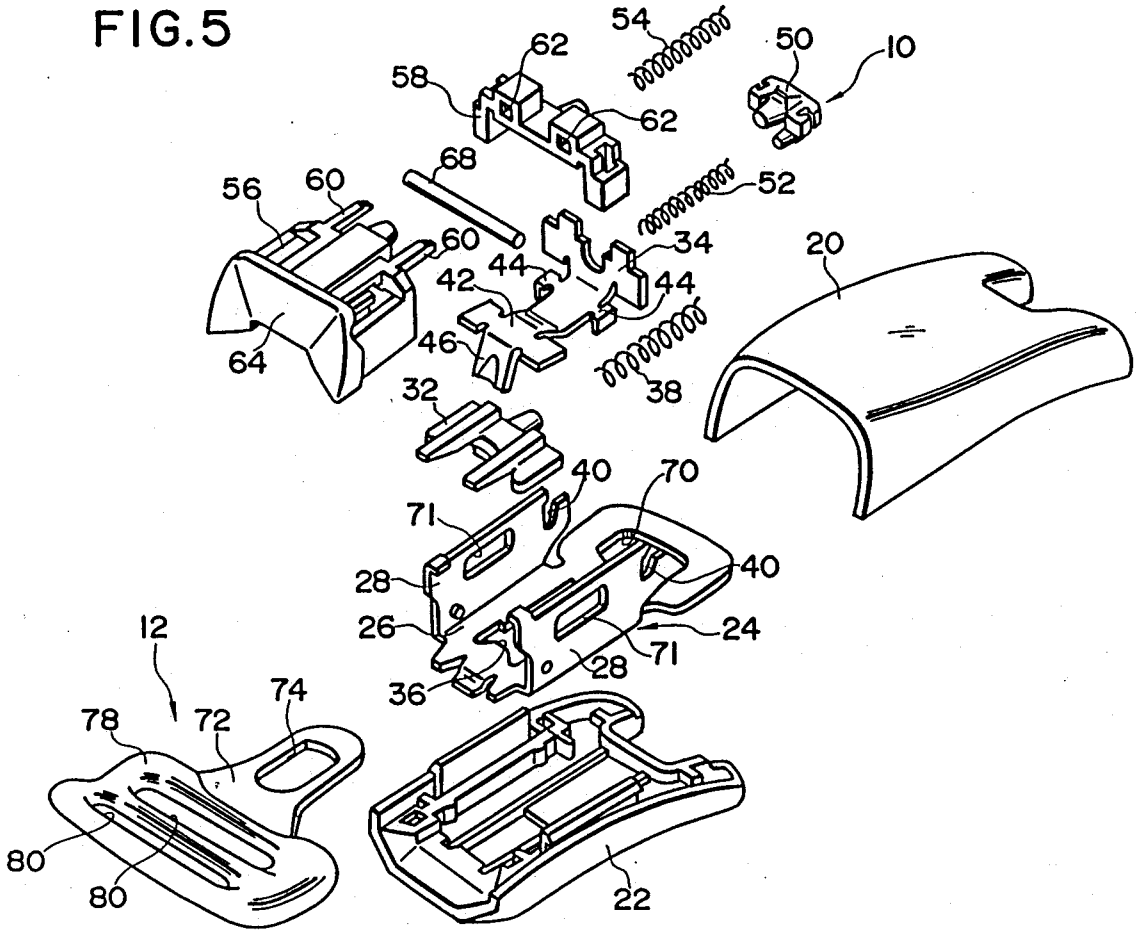
FIG. 5 an exploded perspective view of the first buckle.

In the first buckle 10, as shown in FIG. 3, a buckle body 24 is disposed between an upper cover 20 and a lower cover 22. As shown in FIG. 5, this buckle body 24 comprises a flat plate portion 26 and a pair of erect plate portions 28 formed integrally therewith by bending the transversely opposite side portions of a flat plate. The first tongue plate 12 is adapted to be inserted between this pair of erect plate portions 28 from the left as viewed in FIG. 3.

As shown in FIG. 3, an injector 32 and a lock plate 34, i.e., a lock member, are provided between the pair of erect plate portions 28 of the buckle body 24.

The injector 32 is inserted in a guide hole 36 formed in the flat plate portion 26 of the buckle body 24 so as to be movable only in the direction of insertion and withdrawal of the tongue plate. One end of a compression coil spring 38 (illustrated in FIG. 5) is fitted with a forward end portion of the injector 32 as viewed in the direction of insertion of the tongue plate. The other end of this compression coil spring 38 is retained by the buckle body 24, and urges the injector 32 in the direction of withdrawal of the tongue plate.

A distal end portion of the first tongue plate 12 is adapted to abut against the injector 32 during the insertion of the first tongue plate 12.

A forward end portion of the lock plate 34, as viewed in the direction of insertion of the tongue plate, is fitted in a pair of notches 40 which are respectively formed in the pair of erect plate portions 28 of the buckle body 24. The lock plate 34 is thus made swingable with that forward end portion as the center of the arc.

A U-shaped portion 42, whose tip portion is bent downwardly at a substantially right angle, is formed at a rearward end portion of the lock plate 34, as viewed in the direction of insertion of the tongue plate. In addition, a pair of downwardly bent portions 44 are formed in an intermediate portion of the lock plate 34, as viewed in the direction of insertion and withdrawal of the tongue plate. A tip portion of the U-shaped portion 42 serves as an engaging portion 46 for engaging with the first tongue plate 12.

This lock plate 34 is arranged such that, in a state in which the tongue plate is withdrawn, a distal end of the engaging portion 46 is placed on the injector 32, while the pair of bent portions 44 are disposed at positions spaced apart from the injector 32 in the direction of insertion of the tongue plate. When the injector 32 is moved in the direction of insertion of the tongue plate from the state in which the tongue plate is withdrawn, as shown in FIG. 3, the injector 32 is adapted to be brought into contact with the pair of bent portions 44. In addition, in the position of the lock plate 34 shown in FIG. 4, the lock plate 34 is engaged with the first tongue plate 12.

One end portion of each of two compression coil springs 52, 54 (shown in FIG. 5) is fitted with the forward end portion of the lock plate 34, as viewed in the direction of insertion of the tongue plate, via a spring holder 50. The other end portions of the two compression coil springs 52, 54 are respectively fitted with a release button 56 and a lock pin holder 58 and urge these two members in the direction of withdrawal of the tongue plate.

The release button 56 is provided between the buckle body 24 and the upper cover 20 in such a manner as to be movable in the direction of insertion and withdrawal of the tongue plate. A pair of blocks 60 are formed in this release button 56 such as to project from a forward end portion thereof, as viewed in the direction of insertion of the tongue plate. These blocks 60 are respectively inserted into a pair of square holes 62 (shown in FIG. 5) formed in an upper end portion of the lock pin holder 58 such as to be axially movable, and are adapted to be brought into contact with the forward end portion of the lock plate 34, as viewed in the direction of insertion of the tongue plate, when the release button 56 is moved in the direction of insertion of the tongue plate from the state in which the tongue plate is withdrawn, as shown in FIG. 3.

A rearward end portion of the release button 56, as viewed in the direction of insertion of the tongue plate, is exposed to outside the upper cover 20 and constitutes an operating portion 64, which is adapted to be pressed in the direction of insertion of the tongue plate. This operating portion 64 of the release button 56, together with the lower cover 22, forms an inlet portion 66 of a tongue plate-inserting passage. The first tongue plate 12 is adapted to pass through this inlet portion 66 of the tongue plate-inserting passage and to be inserted between the erect plate portions 28 of the buckle body 24. As shown in FIG. 1A, the width of the inlet portion 66 of the tongue plate-inserting passage becomes gradually narrower in the direction of insertion of the tongue plate from the inlet toward an intermediate portion thereof, as viewed in the direction of insertion of the tongue plate.

In the state in which the tongue plate is withdrawn, the lock pin holder 58 is adapted to clamp the lock pin 68 together with the U-shaped portion 42 of the lock plate 34, as shown in FIG. 3. Axially opposite end portions of the lock pin 68 are respectively inserted through a pair of slits 71 formed in the pair of erect plate portions 28 of the buckle body 24 and the lock pin 68 is thus movable in the direction of insertion and withdrawal of the tongue plate. When the lock plate 34 is placed in a position for engagement with the first tongue plate 12 shown in FIG. 4, this lock pin 68 is urged by the compression coil spring 54 via the lock pin holder 58 and is clamped between the release button 56 and the lock pin holder 58, so as to correspond to the upper end portion of the U-shaped portion 42 of the lock plate 34.

The first buckle 10 is so arranged that a webbing for installation on a chassis (not shown) is inserted through a through hole 70 formed in the flat plate portion 26 of the buckle body 24 and is retained thereat, and the first buckle 10 is installed on the chassis through this webbing.

As for the first tongue plate 12, a through hole 74 is formed in an inserting portion 72 for being inserted into the buckle 10. The through hole 74 is provided in a substantially central portion of the inserting portion 72 and is used for engagement with the lock plate 34 of the first buckle 10. The width of the inserting portion 72 of the first tongue plate 12 is made gradually narrower from a proximal portion toward an intermediate portion thereof. Hence, a portion in the vicinity of the inserting portion 72 is provided with a configuration corresponding to the inlet portion 66 of the tongue plate-inserting passage of the first buckle.

In the first tongue plate 12, a webbing (not shown) for restraining an occupant is inserted through through holes 80 (shown in FIG. 5) formed in an attaching portion 78 located on the opposite side of the inserting portion 72 so as to allow the first tongue plate 12 to be attached to the webbing for restraining the occupant.

The first buckle 10 and the first tongue plate 12 thus constructed are engaged or disengaged with each other as follows.

When engaging the first buckle 10 with the first tongue plate 12, the the first tongue plate 12 in inserted into the first buckle 10 in the state in which the tongue plate is withdrawn, as shown in FIG. 3. Beginning with the tip of the inserting portion 72, the inserting portion 72 of the first tongue plate 12 is inserted into the inlet portion 66 of the tongue plate-inserting passage of the first buckle 10, and is inserted between the erect plate portions 28 of the buckle body 24. After the inserting portion 72 of the tongue plate 12 is inserted between the erect plate portions 28, the tip of the inserting portion 72 is brought into contact with the injector 32 and is moved in the direction of insertion of the tongue plate, while moving the injector 32 in the direction of insertion of the tongue plate. As the injector 32 is moved in the direction of insertion of the tongue plate, the injector 32 is brought into contact with the bent portions 44 of the lock plate, presses the bent portions 44 of the lock plate 34, and is moved in the direction of insertion of the tongue plate while swinging the lock plate 34 counterclockwise, as illustrated in FIG. 3. As the lock plate 34 is swung counterclockwise, as viewed in FIG. 3, the engaging portion 46 is fitted into the through hole 74 of the first tongue plate 12. Simultaneously, the lock pin 68, which is urged by the compression coil spring 54 via the lock pin holder 58, is moved in the direction of withdrawal of the tongue plate. Consequently, the lock pin 68 is clamped by the lock pin holder 58 and the release button 56 and is disposed such as to correspond to the upper end portion of the U-shaped portion 42 of the lock plate 34. As a result, the first buckle 10 and the first tongue plate 12 assume an engaged state shown in FIGS. 1A and 4.

In the state in which the first buckle 10 and the first tongue plate 12 are engaged with each other, the engaging portion 46 of the lock plate 34 is prevented from coming off the through hole 74 of the first tongue plate 12 since the swinging of the lock plate 34 in the direction of allowing the engaging portion 46 of the lock plate 34 to come off the through hole 74 (clockwise as viewed in FIG. 4) is prevented by the lock pin 68. Thus the first tongue plate 12 is prevented from coming off inadvertently the first buckle 10. In this state, the first tongue plate 12 is set in the state shown in FIG. 1A relative to the inlet portion 66 of the tongue plate-inserting passage of the first buckle 10.

Figure 4:
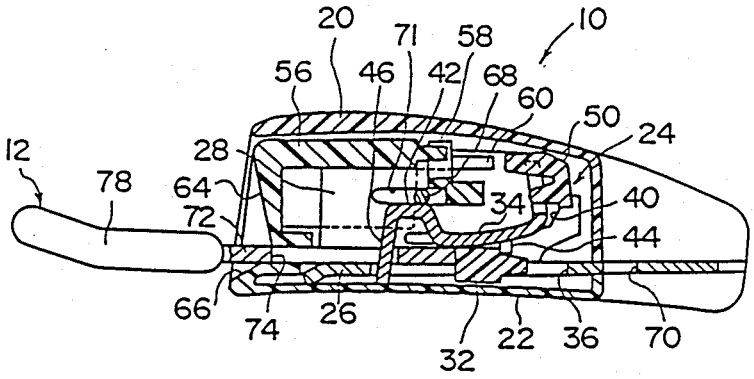
FIG. 4 is a cross-sectional view corresponding to FIG. 3, illustrating a state in which the first tongue plate is engaged with first buckle.

When disengaging the first buckle 10 and the first tongue plate 12 from each other, the release button 56 in the state shown in FIG. 4 is depressed in the direction of insertion of the tongue plate to move in the direction of insertion of the tongue plate in opposition to the urging force of the compression coil spring 52. The release button 56 is then further moved in the direction of insertion of the tongue plate while moving the lock pin 68 and the lock pin holder 58 in opposition to the urging force of the compression coil spring 54 with the lock pin 68 clamped by the release button 56 and the lock pin holder 58. After the lock pin 68 is placed more forwardly than the U-shaped portion 42 of the lock plate 34, as viewed in the direction of insertion of the tongue plate, the blocks 60 are brought into contact with the forward end of the lock plate 34, as viewed in the direction of insertion of the tongue plate, the release button 56 causes the lock plate 34 to swing in the direction of causing the engaging portion 46 of the lock plate 34 to come off the through hole 74 of the tongue plate 12, thereby allowing the engaging portion 46 of the lock plate 34 to be pulled out of the through hole 74 of the tongue plate 12. Simultaneously, the injector 32 is urged by the compression coil spring 38, which in turn causes the first tongue plate 12 to be pushed outside the buckle 10, thereby disengaging the first buckle 10 from the first tongue plate 12.

Figure 6:
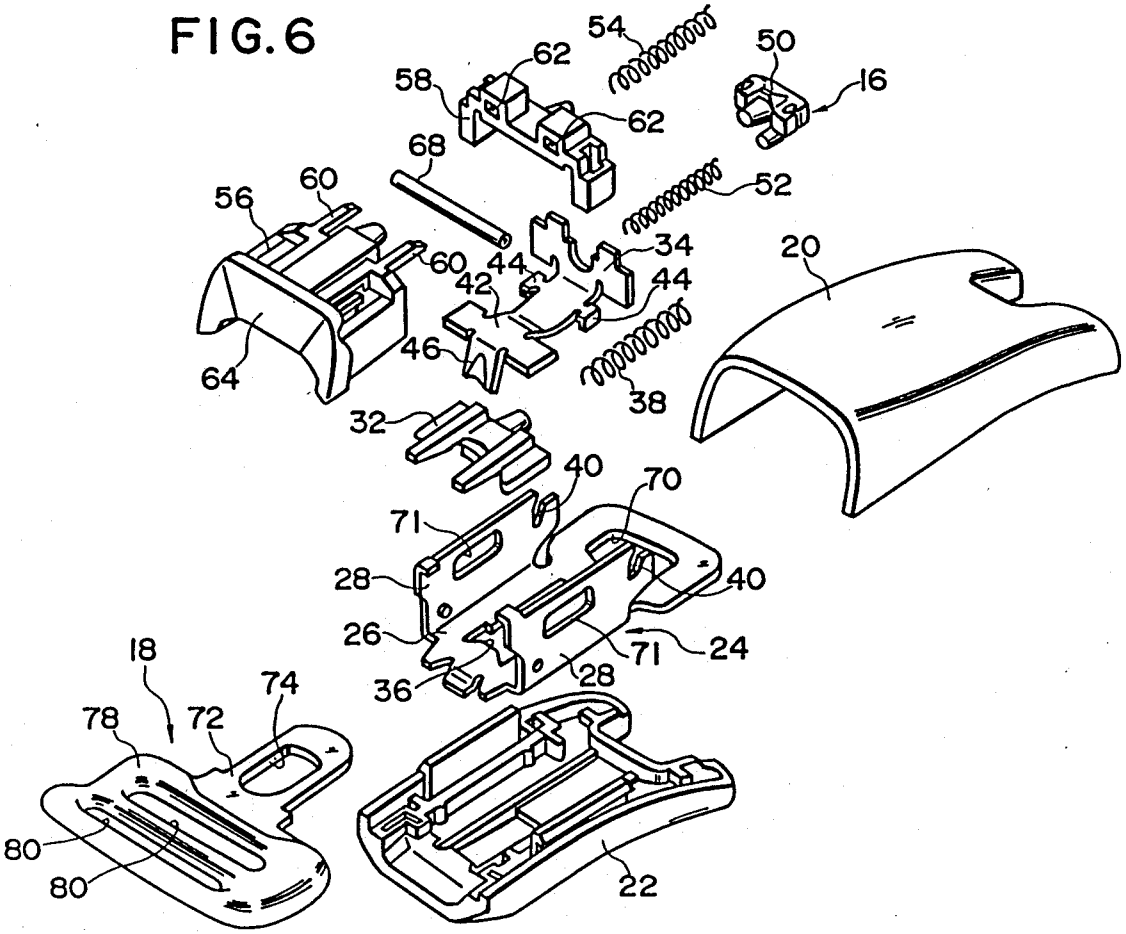
FIG. 6 is an exploded perspective view of the second buckle.

Referring now to FIGS. 1B and 6, a description will be given of the second buckle 16 and the second tongue plate 18. It should be noted that the second buckle 16 and the second tongue plate 18 are basically provided with the same constructions as those of the first buckle 10 and the first tongue plate 12. Therefore, the basically same portions as those of the first buckle 10 and the first tongue plate 12 are denoted by the same reference numerals as those of the first buckle 10 and the first tongue plate 12, and a description thereof will be omitted.

In the second buckle 16, the width of the inlet portion 66 of the tongue plate-inserting passage formed by the operating portion 64 of the release button and the lower cover 22 is made abruptly narrower in the direction of insertion of the tongue plate at an intermediate portion, as viewed in the direction of insertion of the tongue plate, as shown in FIG. 1B. In addition, the inlet portion 66 of the tongue plate-inserting passage is arranged such that a width D1 (shown in FIG. 1B) of the inlet portion 66 of the tongue plate-inserting passage is set to be smaller than a width w (shown in FIG. 1A) of a portion in the vicinity of a proximal portion of the inserting portion 72 of the first tongue plate 12 (i.e., a portion corresponding to an opening of the inlet portion 66 of the tongue plate-inserting passage of the first buckle 10). Namely, in the second buckle 16, the width D1 (shown in FIG. 1B) of the opening of the inlet portion 66 of the tongue plate-inserting passage of the second buckle 16 is set to be smaller than a width d1 (shown in FIG. A) of the first buckle 10. Thus the opening of the inlet portion 66 of the tongue plate-inserting passage in the second buckle 16 is made narrower than in the case of the first buckle 10. In the inlet portion 66 of the tongue plate-inserting passage, a length L (shown in FIG. 1B) from the opening to the narrowed portion in the vicinity of the opening in the direction of insertion of the tongue plate as well as a width D2 (shown in FIG. 1B) of the narrowed portion in the vicinity of the entrance are respectively set to be identical with a length l thereof (shown in FIG. 1A) and a width d2 thereof (shown in FIG. 1A) in the first buckle 10.

In this embodiment, in the second buckle 16, the same components as those of the first buckle 10 are applied with the exception of the lower cover 22 and the release button 56 which constitute the inlet portion 66 of the tongue plate-inserting passage.

The second tongue plate 18 is arranged such that the width of the proximal portion of the insertion portion 72 in the intermediate portion thereof is made abruptly large so as to be provided with a configuration corresponding to the inlet portion 66 of the tongue plate-inserting passage of the second buckle 16. The width W (shown in FIG. 1B) of the widened portion (on the proximal portion side) of the inserting portion 72 of the second tongue plate 18 is set to be smaller than the width D1 (shown in FIG. 1B) of the opening of the inlet portion 66 of the tongue plate-inserting passage of the second buckle 16, and to be greater than the width d2 (shown in FIG. 1A) of the narrowed portion of the inlet portion 66 of the tongue plate-inserting passage of the first buckle 10.

In this embodiment, the construction of the second tongue plate 18 is identical with that of the first tongue plate 12 excepting that the configuration of the vicinity of the proximal portion of the inserting portion 72 is different.

The second buckle 16 and the second tongue plate 18 are engaged with and disengaged from each other in the same way the first buckle 10 and the first tongue plate 12 (see FIGS. 1B, 3 and 4), and a description thereof will be omitted.

In the buckle apparatus thus constructed, if the combination of the buckle and the tongue plate differs from that described above, the following situation occurs.

Figure 7:
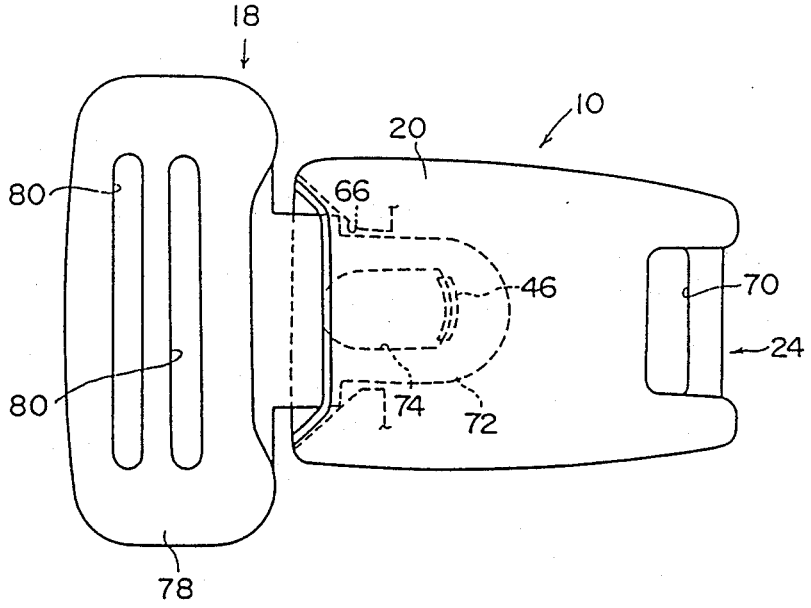
FIG. 7 is a top plan view corresponding to FIG. 1A, illustrating a state in which the second tongue plate is inserted into the first buckle.

For instance, as shown in FIG. 7, when an attempt is made to engage the second tongue plate 18 with the first buckle 10, since the width W (shown in FIG. 1B) on the proximal portion side of the inserting portion 72 of the second tongue plate 18 is greater than the width d2 of the narrowed portion of the inlet portion 66 of the tongue plate-inserting passage of the first buckle 10, and since the proximal portion side of the inserting portion 72 of the second tongue plate 18 is made abruptly large, the second tongue plate 18 cannot be inserted up to a position at which the engaging portion 46 of the lock plate 34 can be fitted into the through hole 74 of the second tongue plate 18. Hence, the second tongue plate 18 and the first buckle 10 cannot be engaged with each other.

Figure 8:
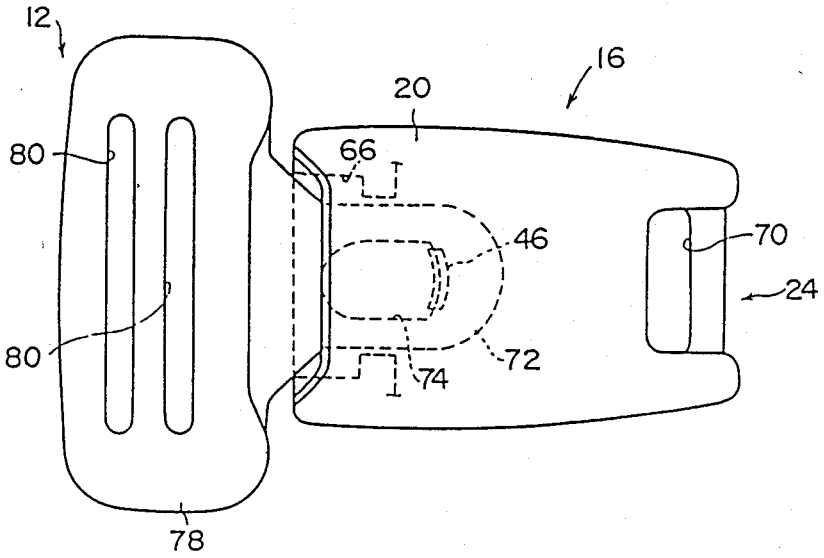
FIG. 8 is a top plan view corresponding to FIG. 1B and illustrating a state in which the first tongue plate is inserted into the second buckle.

In addition, as shown in FIG. 8, when an attempt is made to engage the first tongue plate 12 with the second buckle 16, since the width D1 (shown in FIG. 1B) of of the opening of the inlet potion 66 of the tongue plate-inserting passage of the second buckle 16 is set to be smaller than the width w (shown in FIG. 1A) of the vicinity of the proximal portion of the inserting portion 72 of the first tongue plate 12, the first tongue plate 12 cannot be inserted to a position at which the engaging portion 46 of the lock plate 34 can be fitted into the through hole 74 of the first tongue plate 12. Hence, the first tongue plate 12 and the second buckle 16 cannot be engaged with each other.

Thus, in this embodiment, the engagement of the second tongue plate 18 with the first buckle 10 and that of the first tongue plate 12 with the second tongue plate 16 are made impossible.

It should be noted that since, in the second buckle 16, a multiplicity of the same components as those of the first buckle 10, excluding the lower cover 22 and the release button 56, a multiplicity of components can be used for the first buckle 10 and the second buckle 16, contributing to the lower costs.

In addition, the appearances of the first and second buckles 10, 16 are made substantially identical since the constructions thereof are made identical excepting that the configurations of the lower cover 22 and the release button 56, which form the inlet portion 66 of the tongue plate-inserting passage, are different.

As has been described above, according to the present invention, there is provided a buckle apparatus for use in a plurality of seatbelt assemblies each having a tongue plate and a buckle and disposed adjacent to each other, the buckle being provided with a lock member and being engageable with the tongue plate as the tongue plate is inserted into the buckle, the buckle apparatus comprising: a first buckle having a first portion for forming an opening of a tongue plate-inserting passage and having a large width and a second portion having a width which becomes gradually smaller in the vicinity of the opening in the direction of a forward end of the buckle, as viewed in the direction of insertion of the tongue plate; a second buckle having a third portion having a width which becomes smaller from an opening of the tongue plate-inserting passage to a predetermined position in the direction of insertion of the tongue plate and a fourth portion which is formed continuously from the third portion in the direction of insertion of the tongue plate and whose width is made abruptly smaller than that of the third portion; a first tongue plate which can be inserted into the first buckle up to a position for engagement with the lock member, but which cannot be inserted into the second buckle up to the position for engagement with the lock member, the width of a portion thereof corresponding to the first portion of the first buckle being made larger than that of the third portion of the second buckle; and a second tongue plate which can be inserted into the second buckle up to a position for engagement with the lock member, but which cannot be inserted into the first buckle up to the position for engagement with the lock member, the width of a portion thereof corresponding to the third portion of the second buckle being made abruptly larger than that of the second portion of the first buckle. Accordingly, the present invention has an outstanding advantage in that a buckle of one seatbelt assembly does not engage with a tongue plate of another.

What is claimed is:

1. A buckle apparatus for use in a plurality of seat belt assemblies each having a tongue plate with an identical inserting portion and an identical through hole and a buckle and disposed adjacent to each other, each said buckle being provided with a lock member having an identical shape and being engageable with said through hole of said tongue plate as said tongue plate is inserted into said buckle, said buckle apparatus comprising:

a first buckle having a first portion for forming an opening of a tongue plate-inserting passage and having a large width and a second portion having a width which becomes gradually smaller in the vicinity of said opening in the direction of a forward end of said buckle, as viewed in the direction of a forward end of said buckle, as viewed in the direction of insertion of said tongue plate;

a second buckle having a third portion having a width which becomes smaller from an opening of said tongue plate-inserting passage to a predetermined position in the direction of insertion of said tongue plate and a fourth portion which is formed continuously from said third portion in the direction of insertion of said tongue plate and whose width is made abruptly smaller than that of said third portion;

a first tongue plate which can be inserted into said first buckle up to a position for engagement with said lock member, but which cannot be inserted into said second buckle up to said position for engagement with said lock member, the width of a portion thereof corresponding to said first portion of said first buckle being made greater than that of said third portion of said second buckle; and a second tongue plate which can be inserted into said second buckle up to a position for engagement with said lock member, but which cannot be inserted into said first buckle up said position for engagement with said lock member, the width of a portion thereof corresponding to said third portion of said second buckle being made abruptly larger than that of said second portion of said first buckle.

2. A buckle apparatus according to claim 1, wherein said second portion has a linear configuration.

3. A buckle apparatus according to claim 2, wherein said first portion and said second portion are formed continuously.

4. A buckle apparatus according to claim 3, wherein said fourth portion includes a step formed perpendicularly to the direction of insertion of said tongue plate.

5. A buckle apparatus for use in a plurality of seat belt assemblies each having a tongue plate with an identical inserting portion and an identical through hole and a buckle and disposed adjacent to each other, said tongue plate and buckle having an attaching portion for a webbing to be attached thereto, each said buckle being provided with a lock member having an identical shape and being engageable with said through hole of said tongue plate as an inserting portion of said tongue plate is inserted into said buckle, said buckle apparatus comprising:

a first buckle having a first portion for forming an entrance of a tongue plate-inserting passage and having a predetermined width and a second portion having a width which becomes gradually smaller from said first portion to a predetermined position in the direction of insertion of said tongue plate;

a second buckle having a third portion which extends from an opening of a tongue plate-inserting passage to a predetermined position in the direction of insertion of said tongue plate and whose width is smaller than that of said first portion and a fourth portion which continues from said third portion to a forward end of said buckle, as viewed in the direction of insertion of said tongue plate, via a step and whose width is smaller than that of said third portion;

a first tongue plate which can be inserted into said first buckle up to a position for engagement with said lock member, but cannot be inserted into said second buckle up to said position for engagement with said lock member since the width of a portion thereof corresponding to said first portion of said first buckle is larger than that of said third portion of said buckle and a portion thereof corresponding to said second portion abuts against an opening portion of said tongue plate-inserting passage of said second buckle; and a second tongue plate which can be inserted into said second buckle up to a position for engagement with said lock member, but cannot be inserted into said first buckle up to a position for engagement with said lock member since the width of a portion thereof corresponding to said third portion of said second buckle is set to an intermediate size between said width of said first portion and the width of a forward end portion of said second portion, as viewed in the direction of insertion of said tongue plate, and a forward end portion, as viewed in the direction of insertion of said tongue plate, of a portion thereof corresponding to said third portion is brought into contact with said second portion.

6. A buckle apparatus according to claim 5, wherein said second portion has a linear configuration, and has an inclined surface which intersects the direction of insertion of said tongue plate-inserting direction obliquely therewith.

7. A buckle apparatus for use in a plurality of seat belt assemblies each having a tongue plate with an identical inserting portion and an identical through hole and a buckle and disposed adjacent to each other, each said buckle being provided with a lock member having an identical shape and being engageable with said through hole of said tongue plate as said tongue plate is inserted into said buckle, said buckle apparatus comprising:

a first buckle in which the width of an entrance of a tongue plate-inserting passage is large and the width of said tongue plate-inserting passage in the vicinity of said opening is made gradually smaller in the direction of insertion of said tongue plate;

a second buckle in which the width of an entrance of a tongue plate-inserting passage is made smaller than that of said first buckle and the width of said tongue plate-inserting passage in the vicinity of said opening is made abruptly smaller than that of said entrance in the direction of insertion of said tongue plate;

a first tongue plate which can be inserted into said first buckle up to a position for engagement with said lock member, but cannot be inserted into said second buckle up to said position for engagement with said lock member since the width of a portion thereof corresponding to said large-width portion in the vicinity of said entrance of said tongue plate-inserting passage of said first buckle is made larger than that of said opening of said tongue plate-inserting passage of said second buckle; and a second tongue plate which can be inserted into said second buckle up to a position for engagement with said lock member, but cannot be inserted into said first buckle up to said position for engagement with said lock member since the width of a portion thereof corresponding to said large-width portion of said second buckle in the vicinity of said opening of said tongue plate-inserting passage is made abruptly larger than that of the large-width portion of the first buckle in the vicinity of said opening of said tongue plate-inserting passage.

* * * * *